US008016732B2

(12) United States Patent
Susnjara

(10) Patent No.: US 8,016,732 B2
(45) Date of Patent: Sep. 13, 2011

(54) EXERCISE DEVICE

(76) Inventor: Tony Susnjara, Avalon (AU)

( * ) Notice: Subject to any disclaimer, the term of this patent is extended or adjusted under 35 U.S.C. 154(b) by 0 days.

(21) Appl. No.: 12/295,760

(22) PCT Filed: Apr. 3, 2007

(86) PCT No.: PCT/AU2007/000423

§ 371 (c)(1),
(2), (4) Date: Jul. 9, 2010

(87) PCT Pub. No.: WO2007/112495

PCT Pub. Date: Oct. 11, 2007

(65) Prior Publication Data

US 2010/0267533 A1 Oct. 21, 2010

(30) Foreign Application Priority Data

Apr. 4, 2006 (AU) ..... 2006901757

(51) Int. Cl.
*A63B 26/00* (2006.01)

(52) U.S. Cl. ..... 482/142

(58) Field of Classification Search ..... 482/142, 482/79, 34, 146, 132, 126, 907, 140, 62, 482/141

See application file for complete search history.

(56) References Cited

U.S. PATENT DOCUMENTS

| | | | | |
|---|---|---|---|---|
| 2,351,293 | A * | 6/1944 | Saunders | 482/147 |
| 3,584,871 | A | 6/1971 | Kelmon, Jr. et al. | |
| 4,126,308 | A | 11/1978 | Crumley | |
| 4,193,592 | A * | 3/1980 | Bishow | 472/14 |
| 4,555,081 | A * | 11/1985 | Ermanski | 248/183.2 |
| 4,619,586 | A | 10/1986 | Carter | |
| 4,700,945 | A * | 10/1987 | Rader | 482/132 |
| 5,062,630 | A * | 11/1991 | Nelson | 482/34 |
| 5,279,533 | A | 1/1994 | Yin et al. | |
| 5,433,690 | A | 7/1995 | Gilman | |
| D381,171 | S * | 7/1997 | Culverson | D34/23 |
| 5,879,276 | A | 3/1999 | Miller | |
| D430,635 | S * | 9/2000 | Danache | D21/765 |
| 6,733,428 | B2 * | 5/2004 | List | 482/132 |
| 6,758,483 | B1 * | 7/2004 | Sypniewski | 280/87.041 |
| 7,481,753 | B2 * | 1/2009 | James et al. | 482/140 |

(Continued)

FOREIGN PATENT DOCUMENTS

| | | |
|---|---|---|
| AU | 630854 | 11/1992 |
| AU | 23577/99 | 10/2000 |
| DE | 197 05 852 | 9/1997 |

(Continued)

OTHER PUBLICATIONS

Derwent Abstract Accession No. 94-315295/39 for SU 1818116 dated May 30, 1993.

*Primary Examiner* — Lori Baker
(74) *Attorney, Agent, or Firm* — Ladas & Parry LLP

(57) ABSTRACT

An exercise device for exercising the human body; said device including a first lower platform supported on rolling elements for omni-directional movement over a supporting surface; said device further including a second upper platform rotatably mounted to said first lower platform; said exercise device adapted for support of at least one portion of the body of a user; a further at least one portion of the body of said user in contact with said supporting surface.

18 Claims, 10 Drawing Sheets

U.S. PATENT DOCUMENTS

| | | | | |
|---|---|---|---|---|
| 2003/0060338 | A1* | 3/2003 | Sayce | 482/71 |
| 2003/0180130 | A1* | 9/2003 | Lutz | 414/385 |
| 2004/0211432 | A1* | 10/2004 | Toerner | 128/897 |
| 2006/0035771 | A1* | 2/2006 | Gant | 482/141 |
| 2009/0298656 | A1* | 12/2009 | Dannenberg | 482/141 |
| 2010/0130337 | A1* | 5/2010 | Stewart | 482/121 |
| 2010/0210431 | A1* | 8/2010 | Hinton et al. | 482/141 |

FOREIGN PATENT DOCUMENTS

| | | |
|---|---|---|
| DE | 202 17 908 | 3/2003 |
| GB | 2 144 646 | 3/1985 |
| SU | 1818116 | 5/1993 |
| WO | 90/11802 | 10/1990 |
| WO | 03/068328 | 8/2003 |
| WO | 2006/069409 A2 | 6/2006 |

* cited by examiner

EXERCISE DEVICE

The present invention relates to equipment for exercising the human body and, more particularly, to devices for exercising the musculature, joints and nervous system.

BACKGROUND

Many exercise assisting devices for exercising the human body have been devised, ranging from complex motorised systems for exercising the legs in walking or running to simple sprung devices and weights. For some popular activities such as yoga, break dancing, capoeira playing, gymnastics and martial arts for example, rotation and movements of the lower limbs relative the trunk, and of the upper body relative to the lower are important fitness improving exercises.

Devices which allow rotation and linear movements are known, such as for example the L.I.S.T "Pilates Box" disclosed in U.S. Pat. No. 6,766,428 which allows linear movement of one element relative to another with some rotation relative to the line of movement. However movements of one part of the body relative to another in any direction combined with rotation is not provided for. A further disadvantage of devices such as the Pilates box is that they tend to be heavy and unwieldy.

It is an object of the present invention to address or at least ameliorate some of the above disadvantages.

Note

The term "comprising" (and grammatical variations thereof) is used in this specification in the inclusive sense of "having" or "including", and not in the exclusive sense of "consisting only of".

BRIEF DESCRIPTION OF INVENTION

Accordingly, in a first broad form of the invention, there is provided an exercise device for exercising the human body; said device including a first lower platform supported on rolling elements for omni-directional, movement over a supporting surface; said device further including a second upper platform rotatably mounted to said first lower platform; said exercise device adapted for support of at least one portion of the body of a user; a further at least one portion of the body of said user in contact with said supporting surface.

Preferably, said first lower platform is a substantially planar disc.

Preferably, said second upper second upper platform is a substantially planar disc.

Preferably, said rolling elements comprise at least three rolling elements.

Preferably, the number of said rolling elements is in the range of three to five rolling elements.

Preferably, the number of said rolling elements is in the range of three to nine rolling elements.

Preferably, said rolling elements are swivelling castors.

Preferably, said rolling elements are spherical ball transfer units.

Preferably, said second upper platform is rotatably mounted to said first lower platform by means of a central pin depending from said upper platform; said central pin engaging a central hole in said lower platform.

Preferably, said second upper platform is rotatably mounted to said first lower platform by a thrust bearing.

Preferably, said second upper platform is rotatably mounted to said first lower platform by means of a central shaft depending from said second upper platform; said shaft engaging a supporting central sleeve of said first lower platform Preferably, rotation of said second upper platform relative said first lower platform is by means of a friction minimising intermediate surface layer.

Preferably, rotation of said second upper platform relative to said first lower platform is by means of a selection of materials of said first lower platform and second upper platform respectively; said selection of material adapted to minimise friction between adjoining surfaces of respective said platforms.

Preferably, rotation of said second upper platform relative said first lower platform is unrestricted.

Preferably, said second upper platform is detachable from said first lower platform.

Preferably, said first lower platform is provided with attachment points for releasable attachment of at least one resilient elongate member; said at least one elongate member adapted for attachment to a fixed structure relative said supporting surface.

In a further broad form of the invention, there is provided a method of exercising the human body by means of an exercise device; said method including the steps of;

(a) forming an assembly of an upper platform rotatably supported on a lower platform; said lower platform supported on a plurality of omni-directional rolling elements,
(b) placing said assembly on a supporting surface,
(c) placing at least a portion of the body of a user on said upper platform,
(d) causing said assembly with said at least a portion of said body to move across said supporting surface; at least one other portion of said user in contact with said supporting surface.

Preferably, said plurality of rolling elements are swivelling castors.

Preferably, said plurality of rolling elements are spherical ball transfer units.

Preferably, said method including the further steps of:

(a) attaching a first end of each of at least one elastomer band to an attachment fixture on said lower platform,
(b) attaching a second end of said each of at least one elastomer band to a fixed structure relative said supporting surface.

In a further broad form of the invention, there is provided an exercise device for exercising the human body; said device comprising at least a base platform supported on an array of rolling elements and an upper platform rotatably supported on said lower platform; said rolling elements adapted to allow omni-directional movement of said exercise device over a supporting surface; said device further including a separate immobilizing station for support of said device for use of said device in a stationary location.

Preferably, said lower platform comprises a shallow basin; said basin provided at its underside with an array of recesses; one of said rolling elements located in each of said recesses.

Preferably, each of said rolling elements is a swivelling castor mounted within said recess so as to allow 360 degree rotation of said castor.

Preferably, said upper platform comprises a shallow inverted dish-like element; said element provided at its underside with a downwardly projecting central boss; said boss adapted for insertion through a central aperture in said base platform.

Preferably, said underside of said upper platform is provided with at least one annular track; said at least one annular track adapted for engagement with at least one annular array of supporting wheels; said supporting wheels mounted in structures provided in said base platform; said supporting wheels, arranged to allow free 360 degree rotation of said upper platform relative said base platform.

Preferably, said bate platform is provided with at least one attachment point; said attachment point adapted for attachment of an elastomer strap or band.

Preferably, said at least one attachment point is inserted into a socket provided in said base platform; a portion of said attachment point projecting through an underside of said base platform.

Preferably, said device is provided with a detachable locking member adapted to prevent rotation of said upper platform relative said base platform.

Preferably, said locking member comprises a locking cap; said cap provided with lugs which project through slots in said base platform; said lugs engaging with corresponding slots in said upper platform when said locking member is assembled to said exercise device.

Preferably, an upper surface of said upper platform is provided with an insert of resilient material; said resilient material having a relatively high surface friction; said surface friction similar to surface friction of a yoga mat material.

Preferably, said immobilizing station comprises a central hub; an array of arms projecting outwardly from said hub; each of said arms provided with at least one friction pad on the underside of said arms; the arrangement being such that when said exercise device is located on said immobilizing station, wheels of said castors are in light contact only or free of contact with said supporting surface.

In another broad form of the invention, there is provided a method of providing freedom of movement of at least one portion of a human body relative to another portion of said human body; said method including the steps of;

(a) supporting said at least one portion of said human body on an exercise device adapted for omni-directional movement over a supporting surface, (b) supporting said another portion of said human body on said supporting surface.

In yet another broad form of the invention, there is provided a method of providing reciprocating rotation of a lower portion of a human body relative an upper portion of said human body; said method including the steps of (a) placing the exercise device of any one of claims 21 to 30 on said immobilizing station, (b) standing on said upper platform, (c) rotating said lower portion of said human body reciprocatingly while maintaining said upper portion of said human body relatively constant in direction.

BRIEF DESCRIPTION OF THE DRAWINGS

Embodiments of the present invention will now be described with reference to the accompanying drawings wherein.

DETAILED DESCRIPTION OF PREFERRED EMBODIMENTS

First Preferred Embodiment

Figure 1:
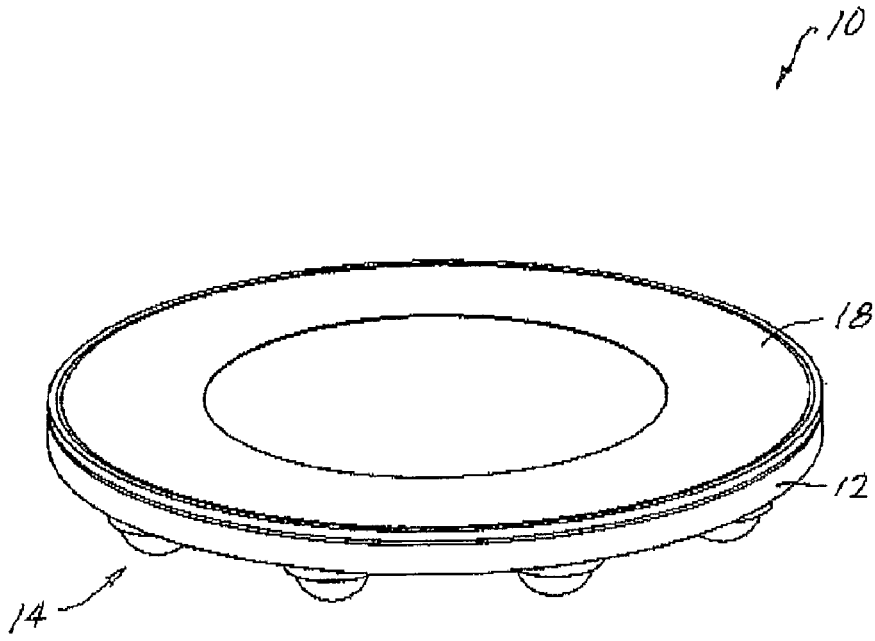
FIG. 1, is a perspective view from above of a first preferred embodiment of an exercise device according to the invention.
Figure 2:
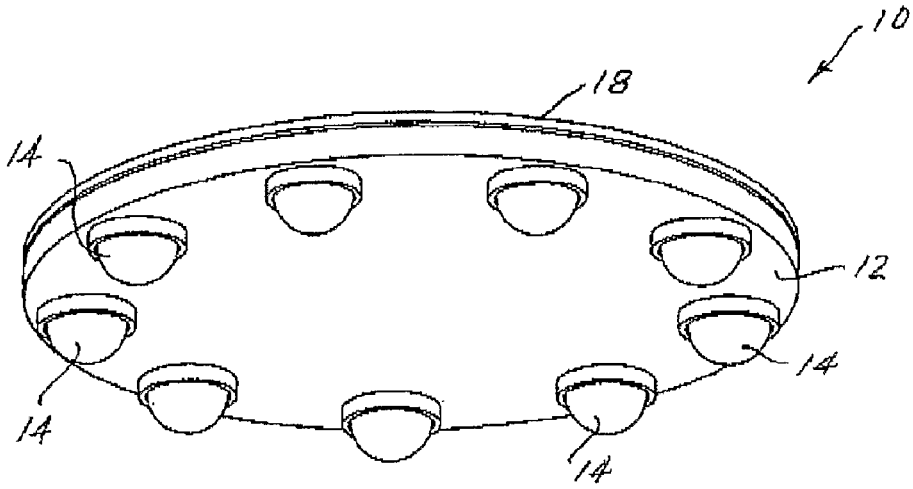
FIG. 2, is a perspective view from below of the embodiment of FIG. 1, FIG. 3, is a part sectioned side view of a first example of a rotatable assembly of the embodiment of the device of FIGS. 1 and 2.

In a first preferred embodiment of the invention with reference to FIGS. 1 and 2, an exercise device 10 includes a first lower platform supported on at least three rolling elements 14. These may take the form of swivelling castors for example or of spherical balls mounted in housings, sometimes known as ball transfers.

Preferably first lower platform 12 is in the shape of a substantially planar disc with a plurality of the rolling elements 14 affixed to the underside 16 of the disc and equispaced around its periphery. The rolling elements 14 will be at least three in number but more are desirable for greater stability of the device. Most preferably, nine rolling elements as shown in FIG. 2, will be employed to ensure that inadvertent tipping of the disc, by a user shifting his or her weight to an edge of the disc, is virtually eliminated.

The plurality of rolling elements allows the exercise device to be urged into motion in any direction across a supporting surface, while supporting the weight of a user. The supporting surface may be a horizontal floor, but the device may also be used on an inclined surface enabling a user to experience both decreased and increased resistance when exercising with the device. Again preferably the diameter of the disc may be in the order of 350 mm, but both larger and smaller discs may be provided.

Figure 3:
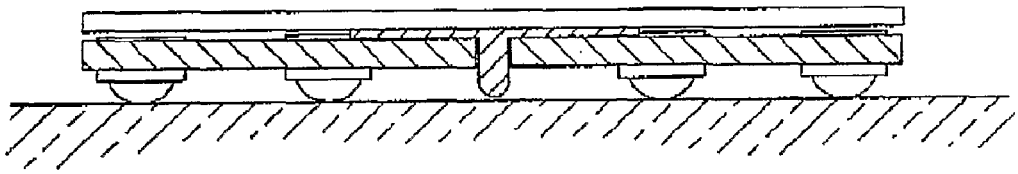

A second upper platform 18 is rotatably mounted to the first lower platform 12. Preferably this second upper platform 18 will also be in the shape of a disc of the same or similar diameter as that of the disc of the first lower platform 12. Rotation between the lower and upper platforms is unrestricted and may be realised in a number of ways well understood by persons skilled in the art. Thus for example in a simplest case as shown in FIG. 3, second upper platform 18 may be provided with a central shaft or pin 20 depending from its underside 22, adapted for insertion as a free sliding fit into a hole or tubular structure 24 provided in the centre of lower platform 12.

A suitable choice of materials for both lower and upper disc to minimise friction between the adjoining surfaces of the platforms then allows rotary movement of the upper platform relative to the lower. Rotation between the upper and lower platforms may also be facilitated by the use of an intermediate layer of friction minimising material such as that provided by Teflon.

Figure 4:
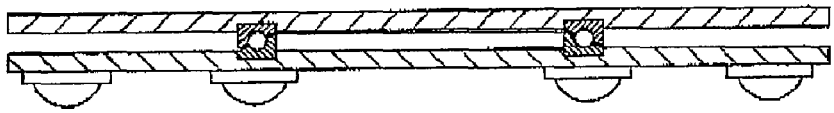
FIG. 4, is a part sectioned side view of a further preferred embodiment of the device of FIGS. 1 and 2, FIG. 5, is a perspective view of the device of FIGS. 1 to 4 in one preferred method of use.

Alternatively, a suitable thrust bearing 26, such as for example used in a "lazy Suzan" construction, may be interposed between the lower and upper platforms as shown in FIG. 4. Depending on the mode of rotation facility chosen, the upper and lower platforms may be made of any suitable substantially rigid material, such as for example plywood, aluminium or plastic.

In at least one preferred form of the invention, the upper platform 18 is removable from the lower platform 12, so as to allow the lower platform 12 to be used where an exercise can better be performed without the second degree of freedom offered by the rotation of the upper platform 18.

A particular feature of the device of the present invention is its low profile relative to the supporting surface. This is particularly advantageous in allowing an exercise in which, while the hands support the upper body on the supporting surface, the lower body which is supported on the device can be swung between the arms. A further advantage of the articulation provided by the omni-directional rolling elements and the swivelling upper platform, is that it allows a continuous free-flowing transition between a variety of exercises. This versatility is particularly important in rotations of the lower body around the axis of the upper body, including full body rotations.

Various dynamic, non-weight bearing exercises can be performed by simply sitting on the supporting surface with the legs in various positions e.g. legs wide, legs crossed and the hands are placed on the board. The board is than rolled in linear and/or circular movement away from and towards the body, thereby mobilising the spine, hips and torso.

Weight-bearing stretches can be performed on the lower body by placing one foot on the device and moving it into and out of lunges, splits etc in both dynamic and static variations.

Figure 5:
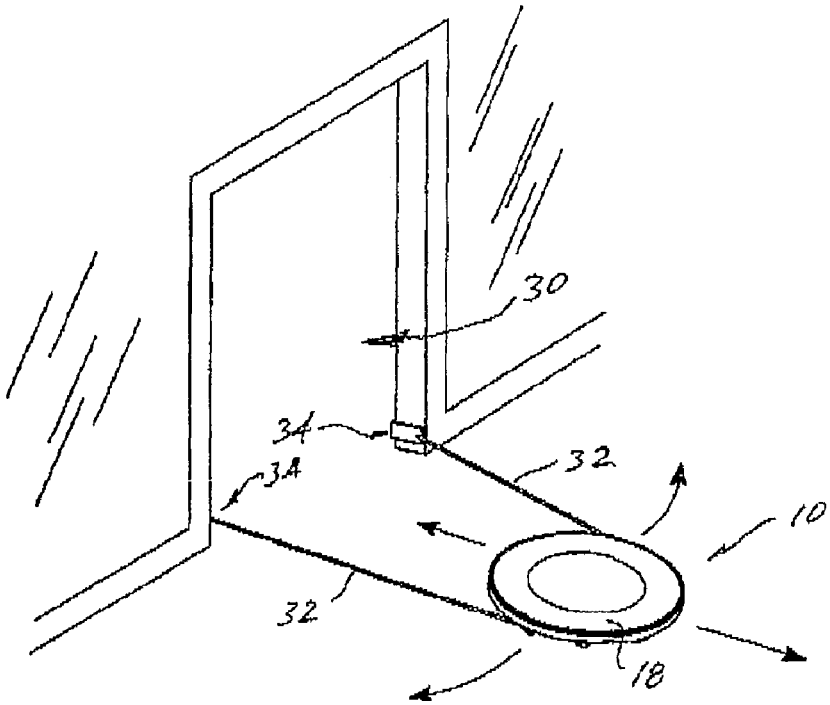
Figure 6:
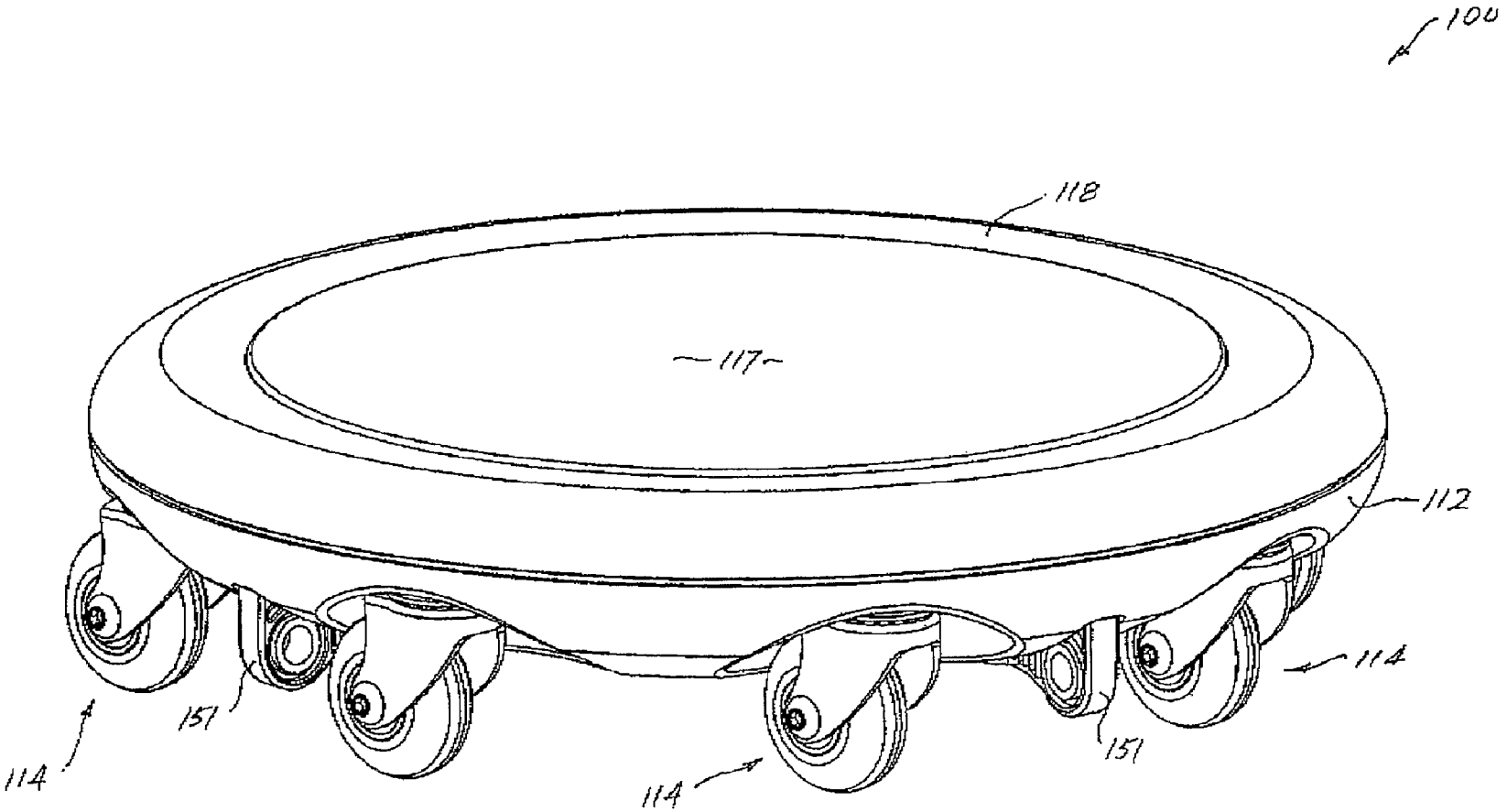
FIG. 6 is a perspective view from above of a second preferred embodiment of an exercise device according to the invention.
Figure 7:
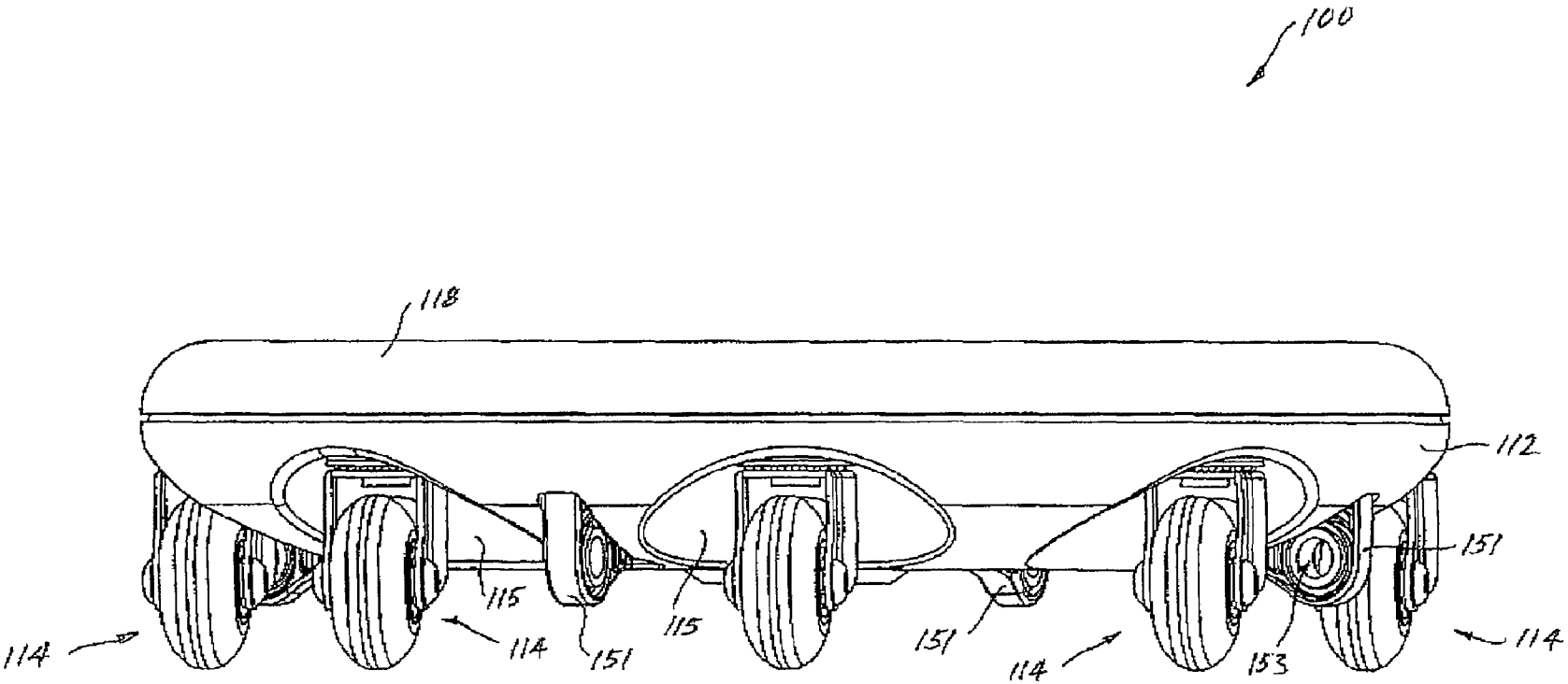
FIG. 7 is a side view of the exercise device of FIG. 6.

In at least one further preferred form of the invention, the lower platform is fitted with at least one, preferably two, suitable attachment points (not shown) for attaching thereto first ends of elastomer straps or bands. The other ends of these bands are provided with attachment elements which allow these ends to be attached to a fixed structure, for example a doorway 30 as shown in FIG. 5, a fixed bracket, clamps 34 or even a sufficiently heavy article of furniture. The elastomer bands 33 thus provide a resistance to movements of the device 10 increasing with the degree of extension induced by a user urging the device away from the remote points of attachment.

Shorter lengths of elastomer bands provided with straps at their outer ends, may be attached to the ankles of a user, allowing stretching exercises in which the upper body is supported on the device with the feet providing purchase on the supporting surface.

Second Preferred Embodiment

With reference now to FIGS. 6 to 9, an exercise device 100 according to this second preferred embodiment again comprises a base platform 112 and swivelling upper platform 118. Base platform 112 is in the form of a shallow circular basin, for example injection moulded from ABS or a similar tough polymer material. Base platform 112 is supported on an array of eight rolling elements; in this embodiment castors 114. Wheels of castors 114 are of low rolling friction and are each mounted in a chassis supported on swivel bearings for free 360 degree rotation.

Figure 8:
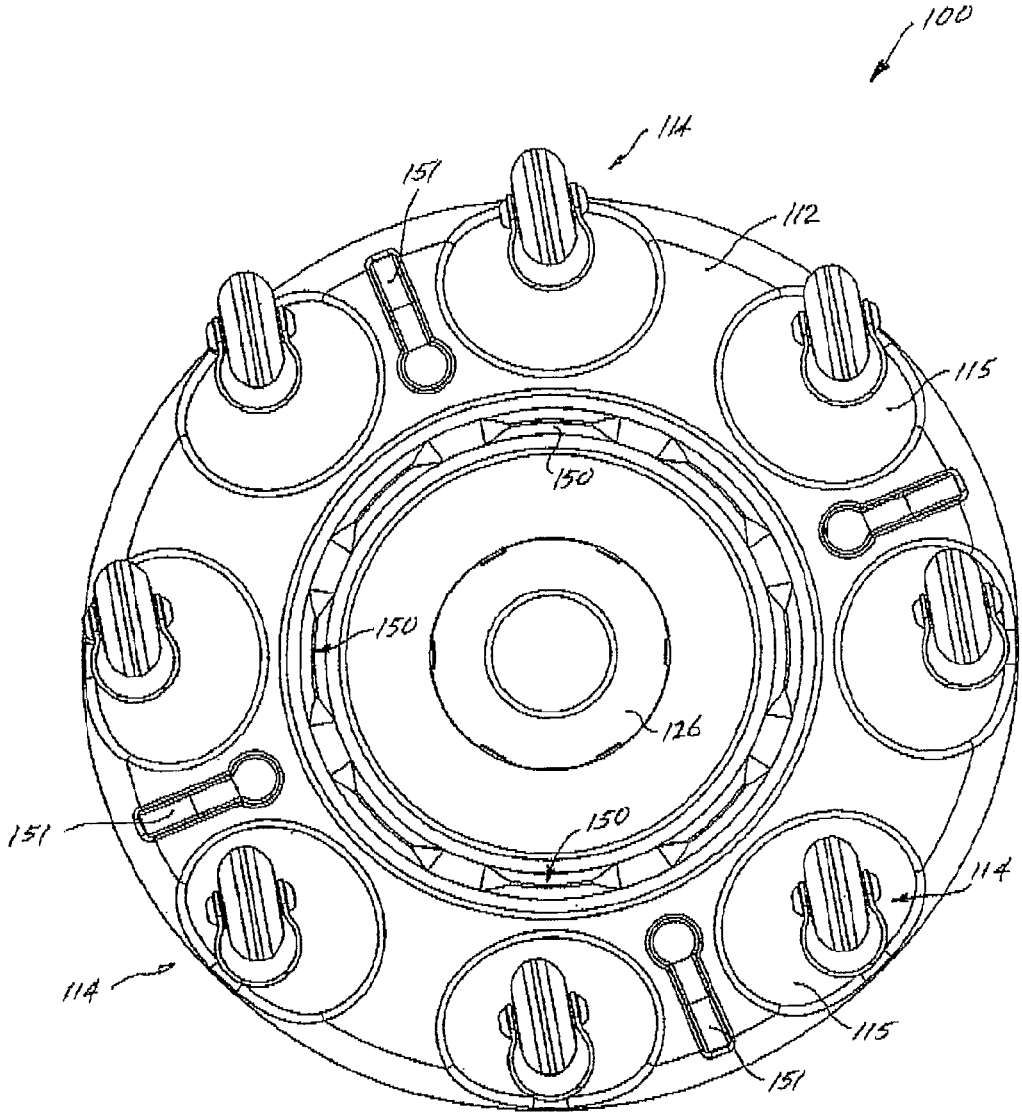
FIG. 8 is a view from below of the exercise device of FIGS. 6 and 7.
Figure 9:
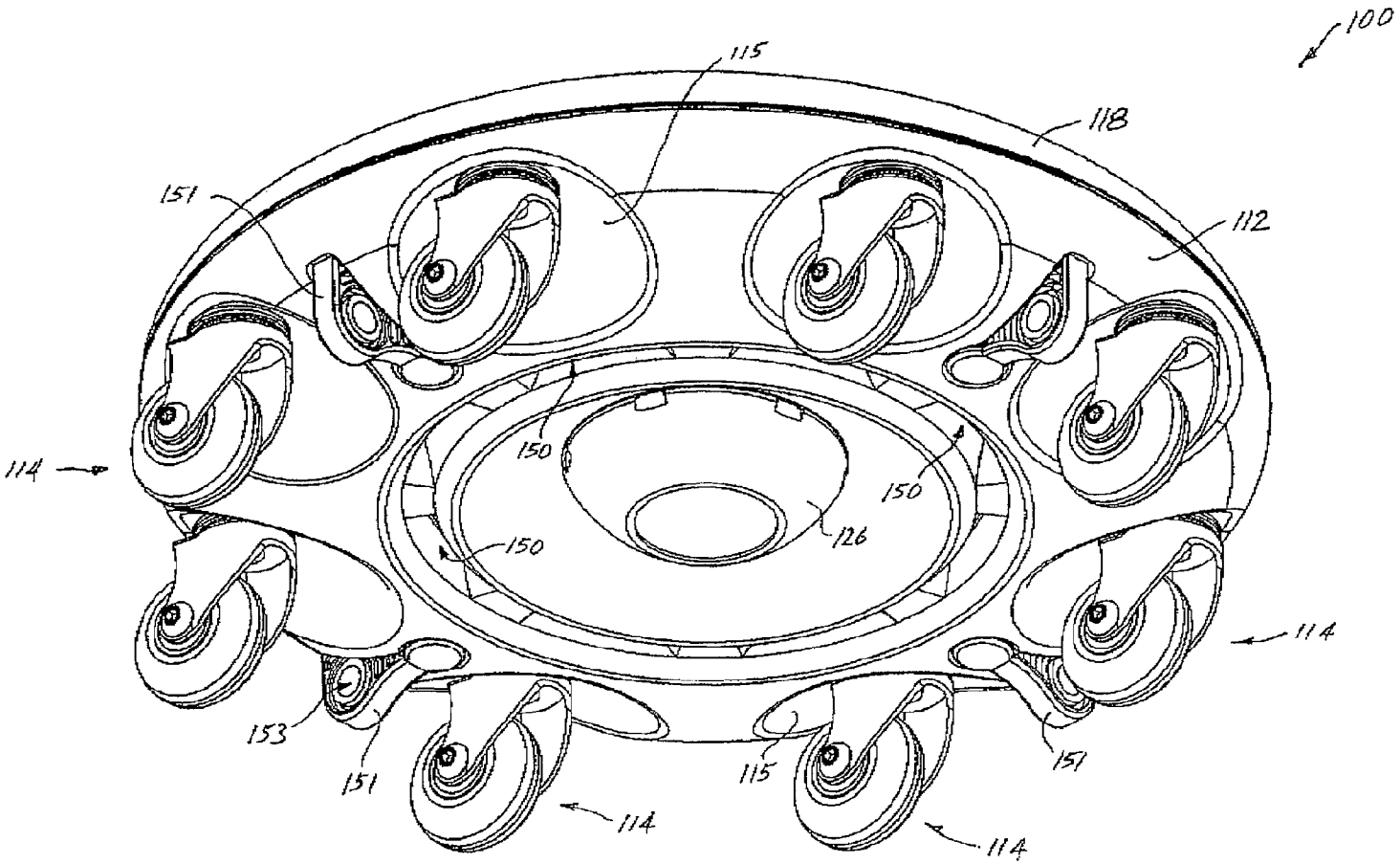
FIG. 9 is a perspective view from below of the exercise device of FIGS. 6, 7 and 8 showing attachment points for elastomer straps or bands for use with the device.
Figure 10:
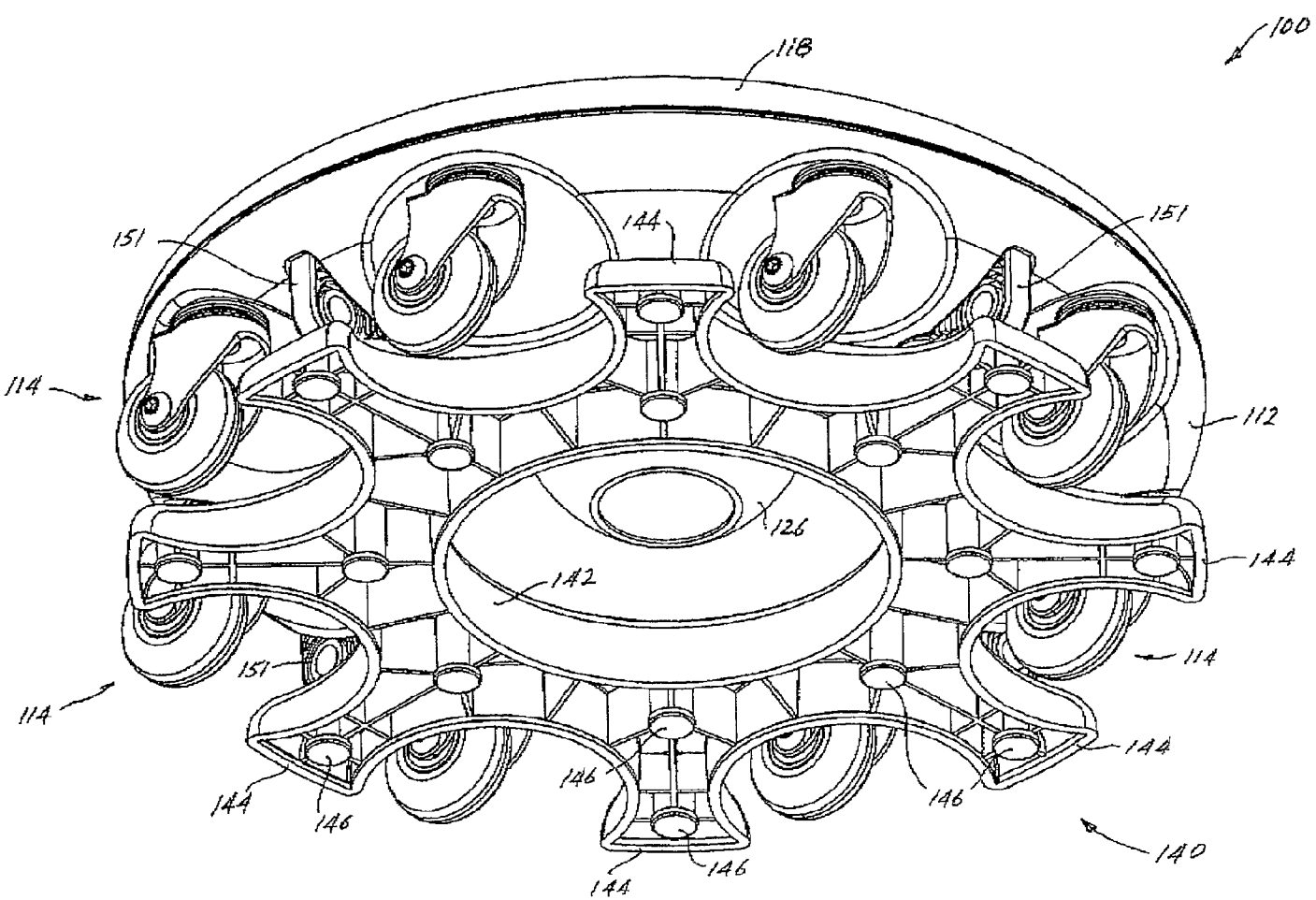
FIG. 10 is a perspective view from below of the exercise device of FIGS. 6, 7 and 8 with an immobilizing station attached.

As shown in FIGS. 8 and 9, castors 114 are equally spaced around the perimeter of base platform 112 and are partly recessed in recesses 115, so as to keep the height of device 100 to a minimum.

Figure 11:
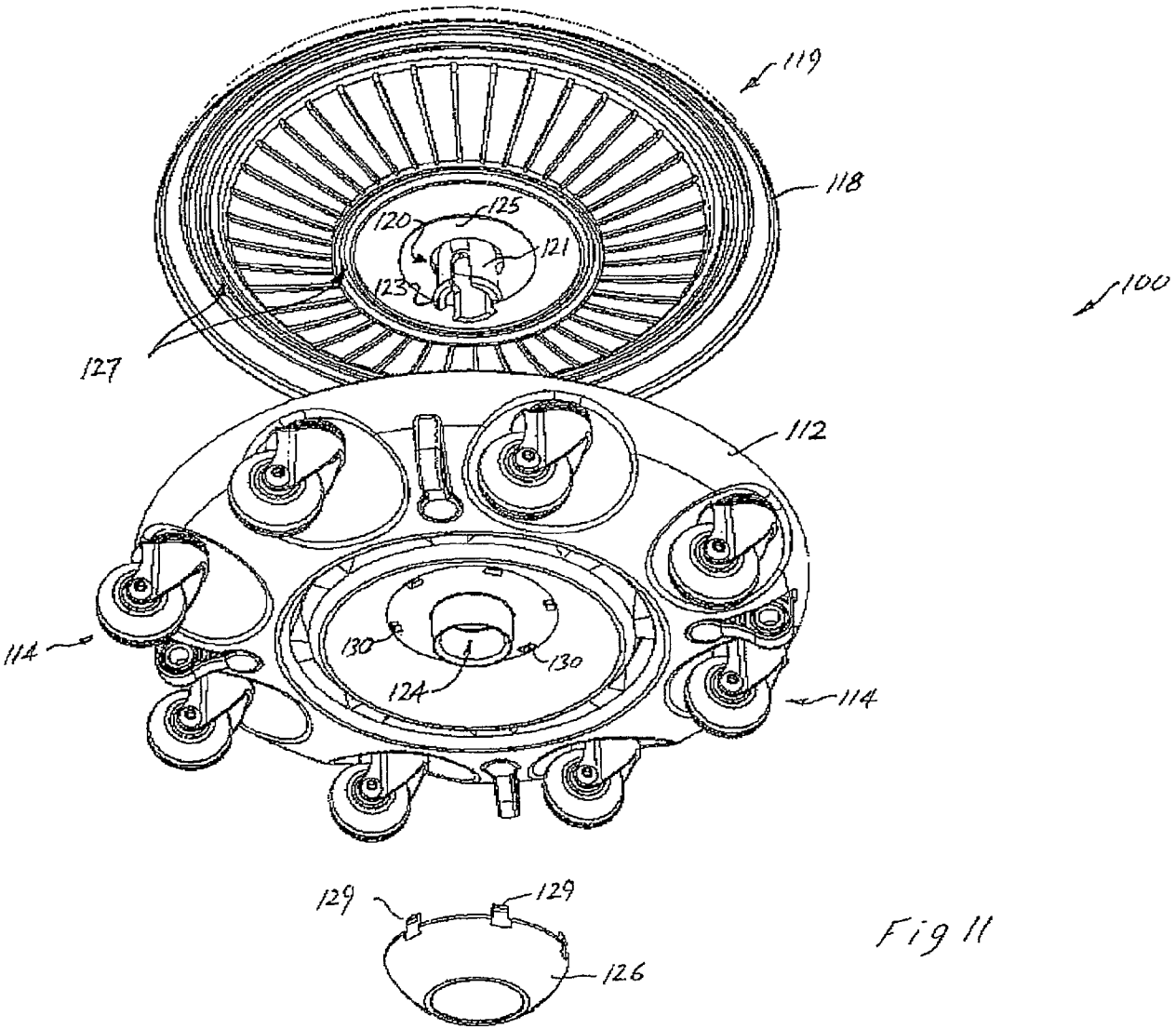
FIG. 11 is a perspective exploded view from below of the exercise device of FIGS. 6 to 9.

As can best be seen in FIG. 11, swivelling upper platform 110 comprises a shallow inverted dish-like element 119, similarly injection moulded. The upper surface of element 119 may be provided with a insert disc 117 of a different material (as shown in FIG. 12), preferably a resilient but high surface friction material similar to that employed in yoga mats for example.

Upper platform 118 is provided at its underside with a downwardly projecting central boss 120. Central boss 120 includes a segmented collar 121 with annular projecting ledges 123 adapted to compress and pass through central aperture 124 in base platform 112, so as to be rotatably retained therein as ledges 123 expand outwardly after passing through aperture 124. A cap 126 provided with lugs 129 provides a cover at the underside of base platform 112 when lugs 129 engage in slots 130 as a snap fit.

For some applications of the exercise device, it may be desirable to prevent rotation of the upper platform 118 relative the base platform 112. For this purpose, in at least one preferred form of this embodiment cap 126 acts as a detachable locking member to prevent this rotation. In this form, again with reference to FIG. 11, the central boss 120 which includes a strengthening ring 125, is then provided with through slots (not shown) spaced around ring 125, corresponding to respective slots 130 and the lugs 129. In this case the lugs are of sufficient length to pass through the slots 130 in base platform 112 and engage with the slots in ring 125 as a snap-fit.

Figure 12:
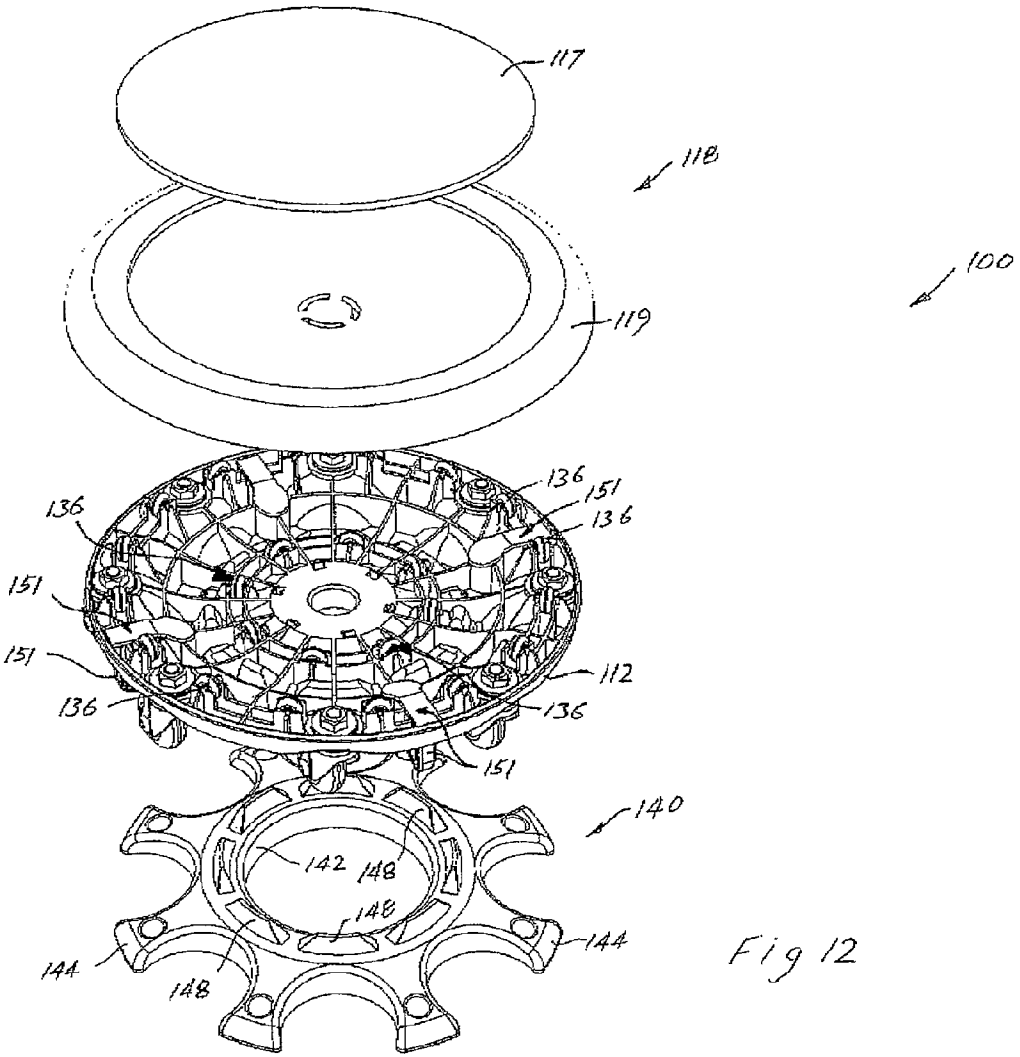
FIG. 12 is a perspective exploded view from above of the exercise device of FIG. 10.
Figure 13:
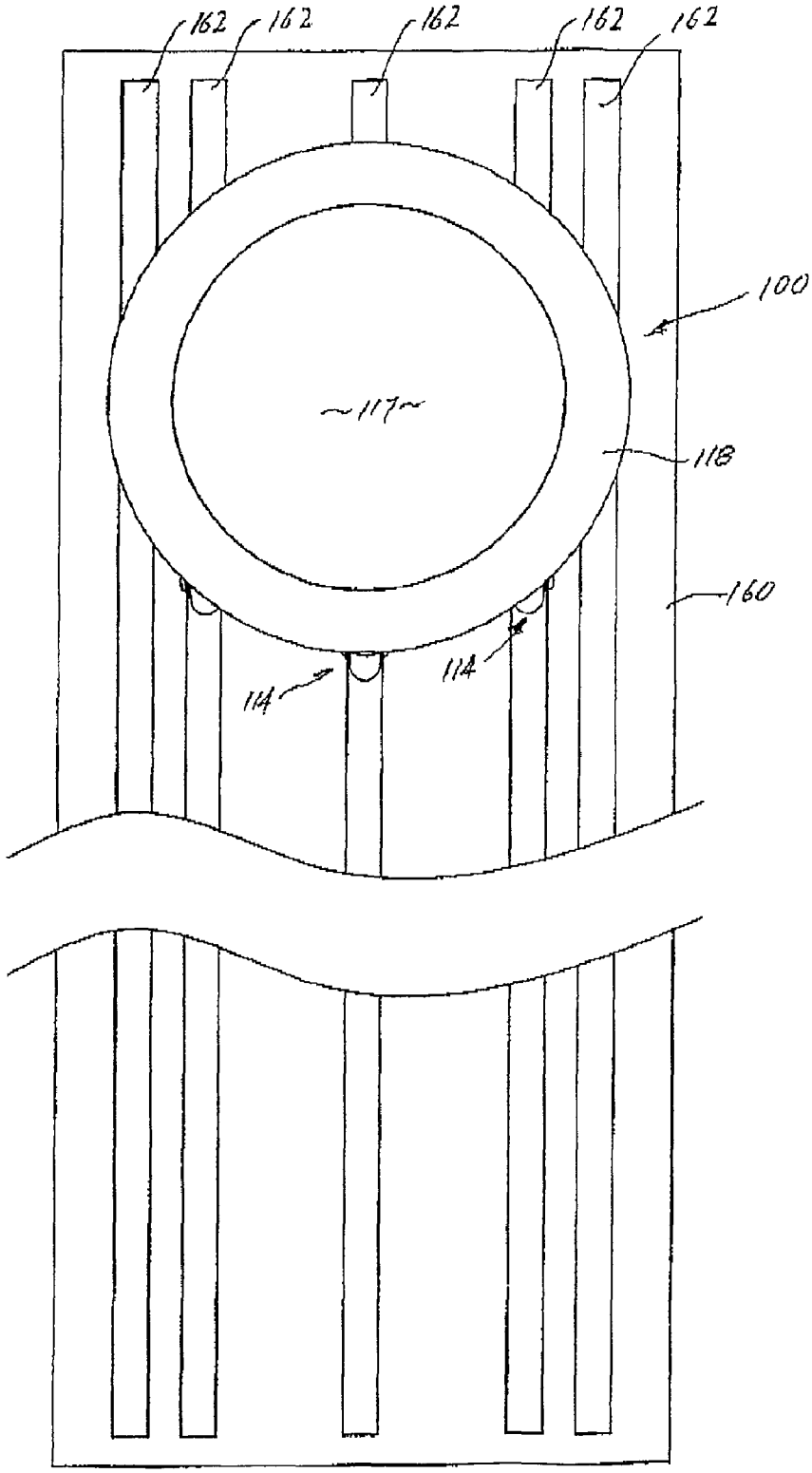
FIG. 13 is a view from above of a linear guide module with the exercise device of FIG. 6.

With reference now to FIG. 12, it can be seen that the top of base platform 112 is provided with a number of support wheels 136 arranged in two concentric circles around the centre of the platform and equally spaced apart. These support wheels 136 preferably are of a rigid plastic construction, rotating about an axle mounted as a snap-fit between adjoining concentric web structures of the platform 112. Alternatively, support wheels 136 may comprised a rigid plastic centre with over-moulded soft polyurethane rim for smoothness and noise reduction. Alternatively again, support wheels 136 could be of metal with polyurethane rim and a bearing for further freedom of rotation and noise reduction. As can be seen in FIG. 11, the underside of the disc 119 of upper platform 118 is provided with two concentric circular tracks 127 which engage with the two circles of support wheels 136 when upper platform 112 is assembled to lower platform 118.

As shown in FIGS. 7 to 11, exercise device 100 is provided with a number of attachment point inserts 151 for attachment of elastomer bands or straps (as shown for example in FIG. 5). The attachment point inserts 151 shown in FIGS. 7 to 11 project from the underside of base platform 112 and are provided with eyelets 153. Attachment point inserts 151 are located in sockets in base platform 112 as can best be seen in FIG. 12 and may be exchanged for different arrangements of attachment inserts, such as ones provided with hooks (not shown) for attachment of loops at the ends of elastomer bands or straps for example. Elastomer bands or straps may be attached to one or more of the attachment inserts 151 to provide elastic constraints to the movement of the device 100 in various directions and in various degrees without impeding the rotation of the upper platform 118.

In another use of the device 100, it is desirable to allow the upper platform 118 to rotate freely relative the base platform 112, but to prevent movement of the device over a supporting surface. For this purpose this embodiment of the invention is provided with an immobilizing station 140 shown assembled to the device in FIG. 10 and disassembled in the exploded view of FIG. 12.

Immobilizing station 140 comprises a central hub 142 and outwardly projecting arms 144, each arm extending between adjoining castors 114 when exercise device 100 is assembled to the immobilizing station 140. Each arm 144 is provided at its underside with at least one friction pad 146 so that when load is applied to the device 100 and transferred to the immobilizing station 140, the whole assembly is highly resistant to movement across a supporting surface.

The central hub 142 of immobilizing station 140 is provided with a number of upwardly projecting tongues 148 (as shown in FIG. 12) to releasably engage with corresponding slots 150 in base platform 112 (shown in FIGS. 8 and 9). The arrangement of the immobilizing station 140 is such that when exercise device is positioned on the immobilizing station, the wheels of castors 114 are in light contact only, or just above a level supporting surface.

In a still further application of exercise device 100, it is desirable to limit the movement of the device to linear forward and rearward movement only. For this purpose the device is provided with a linear guide module 160 as shown in FIG. 12. Linear guide module 160 comprises five parallel channels 162 spaced apart to suit the spacing of the eight castor wheels of the device when all are aligned for linear movement.

The exercise device of the present invention may be provided in one or more sizes. Preferably two diameters are contemplated, 275 mm and 340 mm, with the height of the upper surface of upper platform 118 at 66 mm, It will be appreciated that the principles of the device may be expressed in larger sizes, for example for recreational use on grass surfaces. Embodiments of larger boards may then employ significantly larger castor wheels, with inflatable tyres, and could further include suspension units incorporated in the castors for example to allow use on unpaved outdoor surfaces.

In Use

A large number of exercises for the strengthening of the various joints and muscle groups of different parts of the body can be performed without dismounting from the device. As well as using the device for repetitive "drills", the flexibility of the movements of the lower and upper platforms allow for free-form artistic expression.

The device is particularly effective for strengthening the upper body, providing improvement in endurance and joint stability. As well, pelvic stability may be improved, especially when the device is used in conjunction with elastomer straps.

Some examples of use include, supporting the upper body on a supporting surface or blocks with the feet or knees resting on the upper platform. The lower body may then be swung in virtually any direction exercising the arms and torso with the device moving backwards and forwards in the direction of the axis of the body or swinging from side to side in arcs. These movements may be carried out on a level surface or on a combination of level surface and downward sloping surface such as may be found at a skateboard rink for example.

In another exercise example, with the feet resting on the device the whole body may be rotated 360 degrees about the midpoint of the supporting hands and arms, raising arms in turn as the torso twists around to follow the circling feet and body.

Again, the device can be used when docked on the immobilizing station to allow rotation of the upper body relative to the lower body, by standing on the upper platform and rotating the lower portion of the body reciprocatingly while maintaining the upper body in a relatively constant direction.

In another type of exercise, an elastomer strap tied to the ankles of a user and with one foot on the supporting surface (or preferably on a block of similar height to the device), the leg supported by the device may be stretched away from the other, either in line or rotating in arcs.

The above describes only some embodiments of the present invention and modifications, obvious to those skilled in the art, can be made thereto without departing from the scope and spirit of the present invention.

The invention claimed is:

1. An exercise device for exercising the human body; said device including a first lower platform supported on rolling elements for omni-directional movement over a supporting surface; said device further including a second upper platform rotatably mounted to said first lower platform; said exercise device adapted for support of at least one portion of the body of a user; a further at least one portion of the body of said user in contact with said supporting surface.

2. The device of claim 1 wherein said first lower platform is a substantially planar disc.

3. The device of claim 1 wherein said second upper platform is a substantially planar disc.

4. The device of claim 1 wherein the number of said rolling elements is in the range of three to nine rolling elements.

5. The device of claim 1 wherein said rolling elements are swivelling castors.

6. The device of claim 1 wherein said rolling elements are spherical ball transfer units.

7. The device of claim 1 wherein rotation of said second upper platform relative said first lower platform is unrestricted.

8. The device of claim 1 wherein said second upper platform is detachable from said first lower platform.

9. The device of claim 1 wherein said first lower platform is provided with attachment points for releasable attachment of at least one resilient elongate member; said at least one elongate member adapted for attachment to a fixed structure relative said supporting surface.

10. A method of exercising the human body; said method including the steps of:

(a) forming an exercise device as an assembly of an upper platform rotatably supported on a lower platform; said lower platform supported on a plurality of omni-directional rolling elements;

(b) placing said assembly on a supporting surface;

(c) placing at least a portion of the body of a user on said upper platform;

(d) causing said assembly with said at least a portion of said body to move across said supporting surface; at least one other portion of said user in contact with said supporting surface.

11. The method of claim 10 wherein said plurality of rolling elements are swivelling castors.

12. The method of claim 10 wherein said plurality of rolling elements are spherical ball transfer units.

13. The method of claim 10; said method including the further steps of:

(a) attaching a first end of each of at least one elastomer band to an attachment fixture on said lower platform, (b) attaching a second end of said each of at least one elastomer band to a fixed structure relative said supporting surface.

14. An exercise device for exercising the human body; said device comprising at least a base platform supported on an array of rolling elements and an upper platform rotatably supported on said lower platform; said rolling elements adapted to allow omni-directional movement of said exercise device over a supporting surface.

15. The exercise device of claim 14 wherein said base platform is provided with at least one attachment point; said attachment point adapted for attachment of an elastomer strap or band.

16. The exercise device of claim 14 wherein said device is provided with a locking member adapted to prevent rotation of said upper platform relative said base platform.

17. The exercise device of claim 14 wherein an upper surface of said upper platform is provided with an insert of resilient material; said resilient material having a relatively high surface friction; said surface friction similar to surface friction of a yoga mat material.

18. The exercise device of claim 14 wherein said exercise device further includes an immobilizing station comprising a central hub; an array of arms projecting outwardly from said hub; each of said arms provided with at least one friction pad on the underside of said arms; the arrangement being such that when said exercise device is located on said immobilizing station, wheels of said castors are in light contact only or free of contact with said supporting surface.

* * * * *